United States Patent [19]

Kanamaru et al.

[11] Patent Number: 4,829,950

[45] Date of Patent: May 16, 1989

[54] VALVE LIFTER AND METHOD OF PRODUCING THE SAME

[75] Inventors: Hisanobu Kanamaru, Katsuta; Yosimi Sugaya, Funabashi, both of Japan

[73] Assignees: Hitachi, Ltd., Tokyo; Hitachi Powdered Metals, Chiba, both of Japan

[21] Appl. No.: 44,201

[22] Filed: Apr. 30, 1987

[30] Foreign Application Priority Data

Apr. 30, 1986 [JP] Japan ..... 61-97966

[51] Int. Cl.[4] ..... F01L 1/14

[52] U.S. Cl. ..... 123/90.51; 29/156.7 B

[58] Field of Search ..... 123/90.48, 90.51, 90.52; 29/156.7 B

[56] References Cited

U.S. PATENT DOCUMENTS

| | | | |
|---|---|---|---|
| 1,848,083 | 3/1932 | Wetherald | 29/156.7 B |
| 1,898,426 | 2/1933 | Dannell | 123/90.51 |
| 2,342,199 | 2/1944 | Hurtt | 72/199 |
| 2,891,525 | 6/1959 | Moore | 123/90.51 |
| 4,484,547 | 11/1984 | Nickerson | 123/188 GC |

FOREIGN PATENT DOCUMENTS

| | | | |
|---|---|---|---|
| 55-40269 | 3/1980 | Japan | 123/90.48 |
| 58-176409 | 10/1983 | Japan . | |
| 59-218311 | 12/1984 | Japan . | |

*Primary Examiner*—Andrew M. Dolinar

*Attorney, Agent, or Firm*—Antonelli, Terry & Wands

[57] ABSTRACT

A valve lifter has a cylindrical lifter body portion made of an alloy tool steel which body portion extends in the axial direction of the valve lifter, and a head portion made of the alloy tool steel and formed integrally with the body portion which head portion extends at a right angle to the axis. The head portion has an outer surface constituting a cam-contact surface provided with a coating layer, and an inner surface constituting a valve-pressing portion provided with a valve-pressing protrusion. The head portion has a macrostructure of plastic flow oriented in a direction perpendicular to the above-mentioned axis. Disclosed also is a method for producing this valve lifter.

4 Claims, 5 Drawing Sheets

VALVE LIFTER AND METHOD OF PRODUCING THE SAME

BACKGROUND OF THE INVENTION

The present invention relates to a valve lifter and a method of producing the same. More particularly, the invention is concerned with a valve lifter of the type used in automotive engines and adapted to be actuated by a valve actuating cam and a method of producing such a valve lifter.

Japanese Unexamined Patent Publication No. 218311/1984 discloses a method of producing a valve lifter having a cam-contact portion for sliding contact with a valve actuating cam and a lifter portion for actuating a valve, wherein the cam-contact portion is formed by sintering and is integrated with the lifter portion by means of a liquid phase occurring on the sintered material. Another method for producing a valve lifter is shown in Japanese Unexamined Patent Publication No. 176409/1983 in which a disk-shaped pressure-receiving plate is integrated to the end of the lifter body adjacent to the cam by friction welding. A similar method is disclosed also in Japanese Unexamined Patent Publication No. 40269/1980.

These known methods, however, do not employ any specific measure for ensuring sufficient mechanical strength regarding the lifter head portion at a time when the engine rotates at a high velocity. As a consequence, problems have been encountered such as breakdown of the valve lifter head when the valve lifter operates at high speed in an automotive engine. In order to enhance the strength of the lifter head portion while minimizing wear at the inner and outer surfaces of the lifter head, it has been proposed to cut the valve from an alloy steel which is usually used as the material for metal molds. In this case, since the valve lifter has to be cut from a rod stock of alloy steel, both the production efficiency and cost thereof are such that the cost is raised uneconomically.

Japanese Unexamined Patent Publication No. 40269/1980 discloses a method in which a valve lifter is produced from thin steel sheets by a deep drawing process. In this case, the upper surface of the head portion exhibits only a small resistance to mechanical bending force, so that an additional step is required for bonding a reinforcement or for conducting an additional surface treatment, with the results that both the production efficiency and cost thereof have been degraded.

SUMMARY OF THE INVENTION

Accordingly an object of the present invention is to provide a valve lifter which has a reduced weight but yet exhibits both an improved strength of the head portion and an improved wear resistance at the cam-contact surface thereof.

Another object of the present invention is to provide a method of producing such an improved valve lifter.

To these ends, according to one aspect of the present invention, there is provided a valve lifter comprising: a cylindrical lifter body portion made of an alloy tool steel and extending i an axial direction of the valve lifter; and a head portion made of the alloy tool steel and formed integrally with the body portion which head portion extends at a right angle to the axis, said head portion having an outer surface constituting a cam-contact surface provided with a coating layer, and an inner surface constituting a valve-pressing portion provided with a valve-pressing protrusion, the head portion having a macrostructure of plastic flow oriented in a direction perpendicular to the axis.

Preferably, the coating layer is composed of a carburized layer formed by caburizing, quenching and tempering the external surface of the head portion and a nitrided layer obtained by soft-nitriding the carburized layer.

The thickness of the carburized layer preferably ranges between 0.2 and 0.5 mm, while the thickness of the nitrided layer ranges between 30 and 80 μm.

When the thickness of the carburized layer is below 0.2 mm, the fatigue strength of the product cannot reach the desired level. On the other hand, the toughness of the product becomes bragile when the thickness of this layer exceeds 0.5 mm. When the thickness of the nitrided surface is smaller than 30 μm, the life of the valve lifter becomes too short due to rapid wear of the cam-contact portion. The effect for improving the wear resistance, however, is saturated when the nitrided layer thickness is increased beyond 80 μm.

The carburized layer generally exhibits a hardness of a level between 650 and 830 Hv, while the nitrided layer has a hardness of about 700 to 850 Hv.

The coating layer also may be a single carburized layer of about 0.2 to 0.5 mm thick obtained through carburization, quenching and tempering effected on the external surface of the head portion or a single carburized nitrided layer of 0.2 to 0.5 mm thick formed through carburization and nitriding effected on the external surface of the head portion.

Preferably, the minimum thickness (t) of the head portion defined by the external and internal surfaces of the head portion is more than 1.35 mm but not more than 1.75 mm.

If the minimum thickness (t) of the head portion is 1.35 mm or less, the head portion may be broken by loads of about 1000 kgf applied to the head portion during operation of the valve lifter. Conversely, a minimum thickness which exceeds 1.75 mm becomes quite contrary to the requirement for reduction in the weight and increases the strength to an unnecessarily high level.

Preferably, the alloy steel used as the material of the valve lifter of the invention consists, by weight, of 0.35 to 0.42% C, 0.8 to 1.2% Si, 4.8 to 5.5% Cr, 1.2 to 1.6% Mo, 0.5 to 1.1% V, 0.3 to 0.5% Mn, not greater than 0.03% of P, not greater than 0.01% of S, and the balance substantially Fe and incidental impurities.

According to another aspect of the present invention, there is provided a method of producing a valve lifter comprising the steps of: preparing a disk made of an alloy tool steel; effecting backward cold plastic extrusion of the disk so as to form a cylindrical blank having a bottom which constitutes a cam-contactable head portion of the final valve lifter; effecting cold plastic working on the bottom of the blank so as to form a valve-pressing protrusion on the inner surface of the bottom; cutting the cylindrical blank after the cold plastic work so as to shape the blank into a final form of the valve lifter; and effecting, on the outer surface of the bottom portion constituting the cam-contactable head portion of the valve lifter, a series of heat treatment so as to form a coating layer having superior wear resistance on the cam-contact surface of the head portion.

In order to produce a bottom-equipped cylindrical valve lifter having a head portion and a body portion both integral with each other by the cold-forging of an alloy tool steel through a metal mold, it is necessary to employ two steps: namely, the forming of a bottom-equipped cylindrical body and another forming of a projection on the inner surface of the head portion for constituting a valve actuating portion. Namely, when the valve lifter is formed by a single step of cold working into the final shape, the die tends to be broken in the central region thereof due to stress concentration. Therefore, the object of the present invention is achieved by a method which makes use of an alloy tool steel as the material for the cold plastic working, the alloy tool steel hitherto has been considered as being inappropriate for cold plastic working, wherein the method employs the steps of effecting, on the alloy tool steel stock, a cold plastic working by conducting a cold backward extrusion so as to form a bottom-equipped cylindrical blank, effecting another plastic working of the outside center of the head portion of the blank so that an axial protrusion is formed on the inner surface of the head portion of the blank, and effecting the cutting of the head portion of the blank thus completing the valve lifter. Thus, in the method of the present invention, a valve lifter in the form of a bottom-equipped cylinder and having a head portion and a lifter portion both integral with each other is produced by two steps of plastic working: namely, a plastic working for forming a bottom-equipped cylindrical blank and another plastic working for forming the protrusion on the inner surface of the head portion which serves as a valve pressing portion, whereby any stress concentration in the metal mold is minimized so that the valve lifter can be formed safely even from an alloy tool steel.

BRIEF DESCRIPTION OF THE DRAWINGS

FIGS. 5A to 5E are illustrations of the steps of a method of producing a valve lifter in accordance with the present invention in which:

FIG. 5-A is a plan view of a disk prepared by mechanical cutting of a round rod of an alloy tool steel or by blanking a plate;

FIG. 5-B is an illustration of a cold backward extrusion for forming a bottom-equipped cylindrical blank body from the disk;

FIG. 5-C is an illustration of a cold plastic working for forming a valve-pressing protrusion;

FIG. 5-D is a sectional view of a bottom-equipped cylindrical blank body formed by the cold plastic working; and FIG. 5-E is a sectional view of a valve lifter formed through mechanical cutting, grinding and surface treatments.

FIG. 8(*b*) is an illustration of flow of the metallic material in a valve lifter produced by a conventional mechanical cutting method;

DESCRIPTION OF THE PREFERRED EMBODIMENT

A preferred embodiment of the present invention will be described hereinunder with reference to the accompanying drawings.

Figure 1:
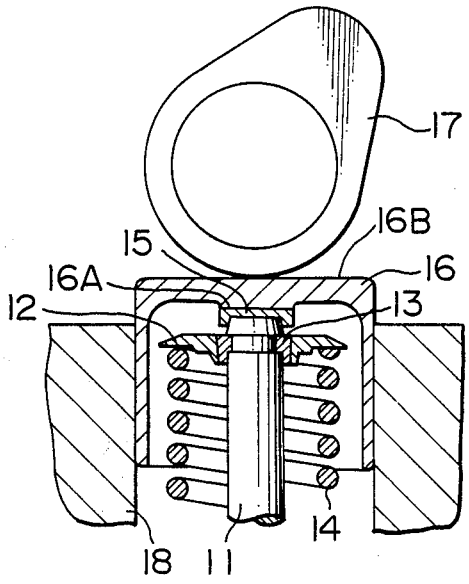
FIG. 1 is a fragmentary sectional view of a valve actuating mechanism incorporating a valve lifter in accordance with the present invention.
Figure 2:
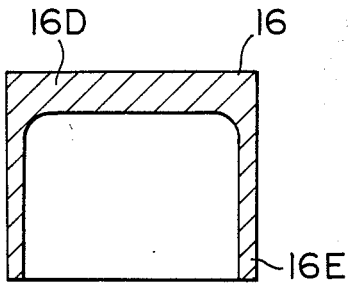
FIG. 2 is a sectional view of a cylindrical body formed by a first step of a method for producing a valve lifter in accordance with the present invention.
Figure 3:
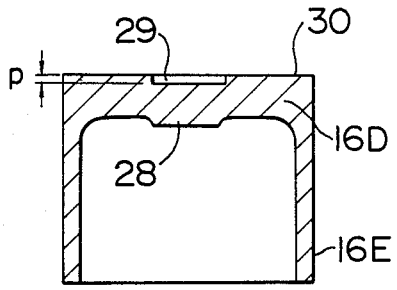
FIG. 3 is a sectional view of the body formed by a second step of a method for producing a valve lifter in accordance with the present invention.

Referring to FIG. 1, a valve stem 11 carries a retainer 12 which is fixed thereto by means of a split-type cotter 13. A valve spring 14 has one end acting on the lower surface of the retainer 12 so as to push the valve stem 11 upward through a valve cap 15. A reference numeral 16 designates a valve lifter which is adapted for sliding up and down along the wall of a guide hole 18 which is formed in one end of a cylinder head. In operation, the valve lifter 16 is moved downward by a cam 17 which is rotated in synchronism with the operation of the engine. As a result, the valve stem 11 is moved downward by the surface of a protrusion 16A on the inner surface of the head portion of the valve lifter 16, thereby opening a valve (not shown).

In view of this function of the valve lifter, the valve lifter preferably is designed to meet the following requirements. Firstly, in order to ensure correct behavior of the valve even in high-speed operation, it is necessary to reduce the mass and, hence, the inertia of the valve lifter which takes up a considerably large portion of the total weight of the valve actuating mechanism. Secondary, it is necessary to enhance the wear resistance both at the cam-contact surface 16B which is in slide contact with the cam 17 and at the valve-pressing surface on the protrusion 16A. It is also necessary that the head portion 16B of the valve lifter 16 has a strength which is large enough to withstand the bending force applied by the cam and the valve.

The valve lifter in accordance with the present invention is characterized in that an alloy tool steel having a hardness of 16 to 20 in terms of Rockwell C scale is used in place of a material JIS S45C having a hardness of not greater than 95 in terms of Rockwell B scale, which S45C material has been considered as being an upper limit material which allows the material to be processed by cold plastic working. In the invention, the alloy tool steel is formed into a valve lifter blank essentially through a cold plastic working, so that a plastic metal flow of the material occurs in the head portion of the valve lifter blank in tee direction substantially perpendicular to the direction of stress occurring in the head portion during the operation of the valve lifter, whereby the mechanical strength of the head portion in the valve lifter can be improved.

[WORKING EXAMPLE]

An alloy tool steel having the following composition was used as the material: 0.35 to 0.43% C, 0.8 to 1.2%

Si, 4.8 to 5.5% Cr, 1.2 to 1.6% Mo, 0.5 to 1.1% V, 0.3 to 0.5% Mn, not greater than 0.03% P, not greater than 0.01% S and the balance Fe and incidental impurities. As the first step, a round bar of this material was cut so as to form a disk 19 as shown in FIG. 5-A. The disk had a diameter D of 21.8 mm and a thickness l of 788 mm. The disk 19 had a hardness of $H_{RC}$ 16 to 18. After forming a coating film of a phosphate on the surface of the disk, the disk was formed into a bottom-equipped cylindrical blank 21 through a cold backward extrusion which was carried out by using a sintered hard punch 20 made of a sintered hard metal JIS: WB-30 at a pressure of 280 to 350 kgf/mm$^2$, as shown in FIG. 5-B. The outside diameter of the punch was 18.6 mm, while the inside diameter of the extrusion die 23 was 21.9 mm. The punch stroke was determined so that the bottom 16D of the blank had a thickness of about 3.3 mm. As a result of this cold backward extrusion, a plastic flow of the material occured in the bottom portion of the cylindrical blank 21 in the direction substantially perpendicular to the direction of the axis of the cylindrical blank. This was in good contrast to the conventional case in which the valve lifter was formed by cutting from a round bar without any cold plastic working so that the plastic flow in the head portion remained in the axial direction of the cylindrical blank. In the above-described process of the invention, the diameter of the punch 2C was so selected that the thickness of the bottom 16D is greater than the wall thickness of the cylindrical portion 16E. Subsequently, a punch 24 having a central projection 25 was placed in opposed relation to the outer surface of the bottom portion 16D of the cylindrical blank and a punch 26 having a central recess 27 was seated on the inner surface of the bottom portion 16D of the cylindrical blank, as shown in Fig. 5-C. The punch 24 was then forced about 1 mm in depth into the bottom portion 16D, whereby a cylindrical member shown in FIG. 5-D was formed which had a protrusion 28 and a recess 29 in the inner and outer surfaces of the bottom portion. The height (u) of the protrusion 28 and the diameter (n) of the same were about 0.8 mm and about 6 mm, respectively. The recess 29 had a diameter (m) of about 7 mm. Alternatively, in place of the die 26, there may be split-type punch having an inside die portion adapted to define the recess 27 and an outside die portion disposed in a surrounding contact relation to the inside die portion.

Figure 6:
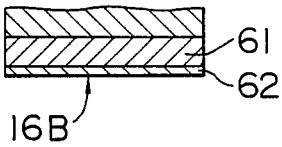
FIG. 6 is a fragmentary sectional view of a cam-contact portion of a valve lifter in accordance with the present invention, illustrating a soft-nitrided layer and a carburized, quenched and tempered layer formed in the cam-contact portion.

Then, the upper side of head portion of the bottom-equipped cylindrical member was removed by an amount (p) by cutting so that a mechanically cut surface is flush with the bottom face of the recess 29, and the outside diameter and the height of the cylindrical body were trimmed by cutting into a desired shape. Then, the outer surface of the head portion of this cylindrical blank body corresponding to the cam-contact surface was carburized and then quenched so as to form a carburized, quenched layer 61 of about 0.3 mm thick from the surface as shown in FIG. 6. The thus treated surface was then tempered and polished. The series of treatment comprising carburization, quenching and tempering was actually carried out as follows. Namely, the carburization was effected at 870° C. for 9 hours and the quenching was effected by dipping the carburized blank into an oil. The tempering was carried out by maintaining the blank at 180° C. for 2 hours, followed by cooling in the air. As a result of this series of treatments, a martensitic structure was obtained. The cylindrical blank having the carburized layer 61 formed in the surface of the head portion corresponding to the cam-contact surface was subjected to a soft-nitriding treatment, so that a nitrided layer 62 of about 80 μm thick from the surface was formed on the carburized layer 61. The carburized layer 61 and the nitrided layer 62 in combination constitute a coating layer. The formation of dual layer, however, is not exclusive and the coating layer may be composed only of the carburized layer or only of a carburized and nitrided layer. Surfaces other than the cam-contacting surface may be subjected to only the carburizing, quenching and tempering treatment.

The carburization was conducted in a carburizing atmosphere which contains hydrocarbons ($CH_4$ or $C_3H_8$ or $C_4H_{10}$), $H_2$, CO and $H_2O$ gas, as well as trace amount of $CO_2$. The soft-nitriding treatment was conducted by dipping for 1 to 2 hours in a bath of a cyan salt or cyanate maintained at 570° C.

The valve lifter thus formed had an outside diameter of 20 mm, a height of 16 mm, and an inside diameter of 18.5 mm. The minimum thickness of the cam-contact portion was 1.5 mm and the thickness of the valve pressing portion was 2.5 mm.

Figure 4:
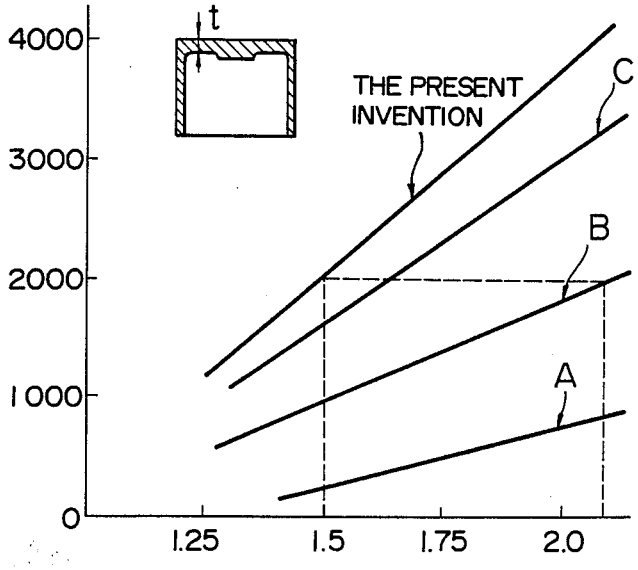
FIG. 4 is a graph showing the strength of a valve lifter in accordance with the present invention in comparison with strengths of other valve lifters.
Figure 5A:
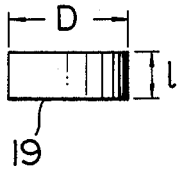
Figure 5B:
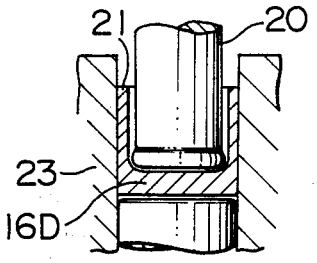
Figure 5C:
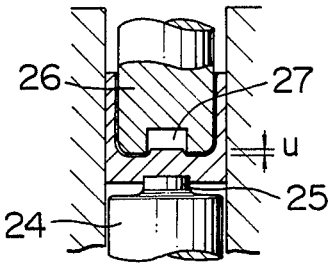
Figure 5D:
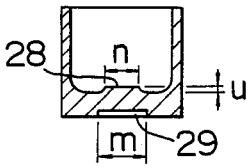
Figure 5E:
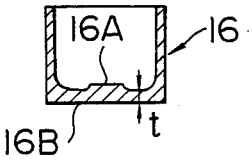
Figure 7:
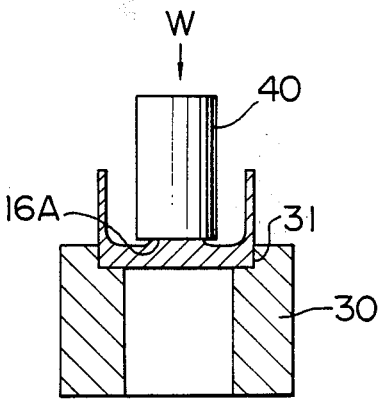
FIG. 7 is an illustration of the manner in which a bending test of a valve lifter is conducted.

In order to verify the strength of the valve lifter of the present invention, a bending test was carried out by using a plurality of samples of the valve lifter which were fabricated by the same process as the working example with the minimum thickness (t) of the cam-contact portion being varied within the range between 1.25 and 2.0 mm. FIG. 7 illustrates the manner in which the bending test was conducted. A cylindrical base 30 has an upper surface which is recessed as at 31 so as to form an annular shoulder 31 on which the cam-contact surface 16B of the valve lifter was placed. A weight or load W was applied to the valve-pressing portion 16A of the valve lifter through a columnar member 40 in the direction of axis of the valve lifter. The level of the load at which the valve lifter was ruptured was determined as the bending rupture load. The result of the bending test is shown in FIG. 4. For the purpose of comparison, FIG. 4 also shows the results of bending tests which were carried out on conventional valve lifters A, B and C which were produced as follows. Namely, the valve lifter A was of the type shown in Japanese Patent Laid-Open No. 218311/1984 mentioned before in which a sintered cam-contact surface is integrated with a valve lifter head portion by making use of a liquid phase occurring in the sintering thereof. That is, the valve lifter A was produced by a process having the steps of preparing an alloy powder having a composition essentially consisting of 4 to 7% Cr, 0.5 to 2% Mo, 0.5 to 2% V, 0.15 to 0.35% P, 1.8 to 2.5% C and the balance substantially Fe, placing the alloy powder on the outer surface of the bottom of a bottom-equipped cylindrical member made of a material specified as JIS: S10C, sintering the alloy powder at a temperature of 1100° to 1150° C. at which the liquid phase occurs to bond the sintered layer to the cylindrical member, and effecting carburizing, quenching and tempering followed by polishing. The valve lifter B was manufactured by mechanical cutting from an alloy tool steel containing 11 to 13% Cr, 0.80 to 1.20% Mo and 0.2 to 0.5% V. The valve lifter C was manufactured solely by mechanical cutting from a round bar of the same alloy tool steel as that used in the working example of the instant invention explained before.

From FIG. 4, it will be understood that the valve lifter in accordance with the present invention exhibits superior strength as compared with the comparison valve lifters A to C. As a consequence, according to the present invention, the minimum thickness of the head portion can be reduced to a value which is more than 1.35 mm but is not greater than 1.75 mm. The weight of the valve lifter also can be reduced to about 8 g, which is about a 20% reduction as compared with the conventional valve lifter which weighed about 10 g. As will be clearly understood from broken-lines in FIG. 4, the valve lifter in accordance with the present invention having a minimum cam-contact portion thickness (t) of 1.5 mm shows greater bending rupture strength than the comparison conventional valve lifters having minimum cam-contact portion thickness (t) of 2 mm.

Figure 8A:
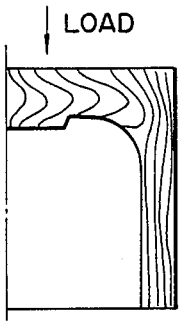
FIG. 8(*a*) is a illustration of the plastic flow of the metallic material in the production of a valve lifter in accordance with the present invention.
Figure 8B:
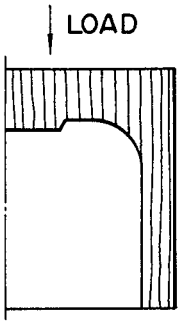

From FIG. 4, it will also be seen that the strength of the head portion of the valve lifter in accordance with the present invention formed by cold plastic working is about 30% greater than that of the valve lifter C which was manufactured solely by mechanical cutting. This is attributable to the following fact. In general, the head portion of the valve lifter is required to exhibit a large strength in the axial direction of the valve lifter. In the valve lifter in accordance with the present invention, the head portion has a macrostructure of plastic flow oriented in the direction substantially perpendicular to the direction in which the load is applied, as will be seen from FIG. 8*a*. In contrast, in conventional valve lifters which are fabricated solely by mechanical cutting from a round bar, the head portion has a macrostructure of plastic flow oriented in a direction of application of the load as shown in FIG. 8*b*. Thus, the head portion of the valve lifter in accordance with the present invention exhibit a higher resistance to the load than the head portions in the known valve lifters.

In order to confirm the wear resistance of the cam-contact surface of a valve lifter in accordance with the present invention, wear resistance test pieces each having a rectangular cross-section of 10 mm long and 7 mm wide an having a length of 60 mm were obtained from the same material used in the working example explained above and from the material of the cam-contact surface of the conventional valve lifter A, and were subjected to treatments as shown in the following table.

TABLE

| Type | Test piece for wear resistance | Material | Heat treatment and surface treatment | Surface Hardness | Conditions of heat treatment |
|---|---|---|---|---|---|
| Present Invention | No. 1 | Material used in the working example (Cold Forged) | Carburized, quenched, and tempered | $H_RC60$ | Continuous Furnace 870° C. × 9 hours, 165° C. × 2 hours |
| | No. 2 | Material used in the working example (Cold Forged) | Carburized, quenched, tempered and soft-nitrided | $H_RC47$ | Continuous furnace 870° C. × 1 h, 595° C. × 3 h |
| Prior Art | No. 3 | Sintered material used in the valve lifter (A) | Carburized, quenched and tempered | $H_RC62$ | Continuous furnace 870° C. × 9 h, 165° C. × 2 h |

Figure 9:
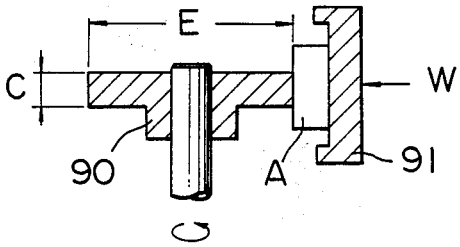
FIG. 9 is a schematic illustration of a wear-resistance test.
Figure 10:
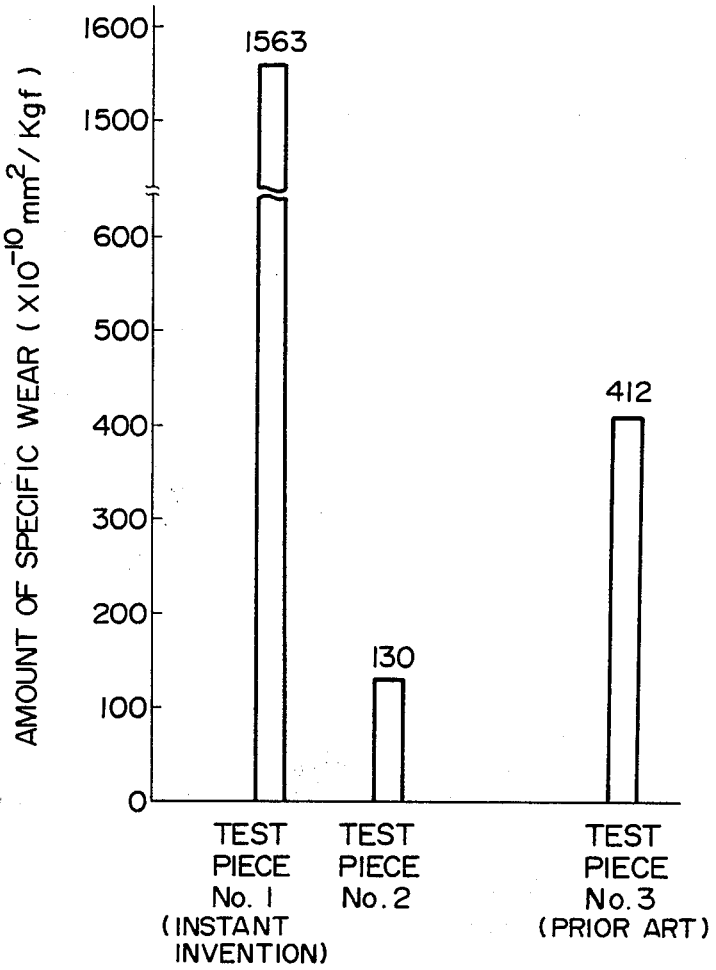
FIG. 10 is a graph showing the result of the wear-resistance test.

The thus treated test pieces were subjected to a wear test conducted by using Okoshi-type wear tester shown in FIG. 9. Referring to FIG. 9, the test piece A was held between the rotor 90 and the support 91. A load W is applied to the support 91 in the direction perpendicular to the axis of tee rotor. The rotor 90 had a diameter of 30 mm and a thickness of 3 mm. The rotor 90 was made from the same material as the cam and had undergone the same heat-treatment as the cam. Namely, the cam was produced from a chrome-molybdenum steel essentially consisting of 0.18 to 0.23% C, 0.15 to 0.35% Si, 0.60 to 0.85% Mn, 0.90 to 1.20% Cr, 0.15 to 0.35% Si and the balance substantially Fe, and the chrome-molybdenum steel had been subjected to a surface treatment comprising carburization, quenching and tempering. With the test piece A arranged as shown in FIG. 9, the wear resistance test was carried out while using a motor oil as a lubricant, under the application of the load W of 18.9 kgf and at a friction speed of 3.6 m/sec. The result of the test is shown in FIG. 10. As will be understood from this Figure, the test piece simulating the valve lifter described in the working example of the invention, which was subjected to soft-nitriding in addition to the carburization, quenching and tempering, exhibits only a small wear which was about 1/12 of that shown by the test piece No. 2 which has undergone only carburization, quenching and tempering and which has superior to that exhibited by the test piece No. 3 made from the conventionally used material.

As will be understood from the foregoing description, according to the present invention, the valve lifter in accordance with the present invention produced from an alloy tool steel by cold plastic working brings about a plastic flow oriented in the direction perpendicular to the axis of the valve lifter in the head portion thereof where the requirements for axial strength are most critical. As a consequence, the head portion of the valve lifter in accordance with the present invention exhibits a superior axial strength which is large enough to withstand the load applied to the head portion, as well as a high resistance to wear.

In another aspect, the present invention provides a method of producing a valve lifter by a cold plastic working which is carried out in two steps. Since the cold plastic working is conducted in two separate steps, it is possible to form the valve lifter without any risk of the die being broken, from an alloy tool steel which, according to the conventional wisdom in the field of technology concerned, had been considered as being materially impossible to process by cold plastic working.

It is also to be noted that the valve lifter in accordance with the present invention is superior both in the wear resistance and the strength of the head portion thereof by virtue of the composite coating layer composed of an outer nitrided layer and an inner carburized layer.

As will be fully understood from the foregoing description, according to the invention, it is possible to obtain a valve lifter and a method of producing the same, which reduces the cost thereof by making an economical use of the material and enhancing the strength in the lifter head, while reducing the weight of the valve lifter.

What is claimed is:

1. A valve lifter comprising:

a cylindrical lifter body portion made of an alloy tool steel and extending in the axial direction of the valve lifter; and a head portion made of said alloy tool steel and formed integrally with said body portion which head portion extends at a right angle to said axis;

said head portion having an outer surface constituting a cam-contract surface provided with a coating layer, said coating layer being composed of a carburized layer obtained by carburizing, quenching and tempering of the outer layer of said head portion, and a nitrided surface obtained by soft-nitriding of said carburized layer, and an inner surface constituting a valve-pressing portion provided with a valve-pressing protrusion, said head portion having a macrostructure of plastic flow oriented in a direction perpendicular to said axis.

2. A valve lifter according to claim 1, wherein said carburized layer has a thickness ranging between 0.2 and 0.5 mm from the surface of said head portion and said nitrided surface has a thickness ranging between 30 and 80 μm from the surface thereof.

3. A valve lifter according to claim 1, wherein the minimum thickness (t) of said head portion determined by the outer and inner surfaces of said head portion is more than 1.35 mm but not more than 1.75 mm.

4. A valve lifter according to claim 1, wherein said alloy tool steel has a composition consisting, by weight, of 0.35 to 0.42% C, 0.8 to 1.2% Si, 4.8 to 5.5% Cr, 1.2 to 1.6% Mo, 5 to 1.1% V, 0.3 to 0.5% Mn, not more than 0.03% P, not more than 0.01% S and the balance substantially Fe and incidental impurities.

* * * * *